US010627740B2

(12) United States Patent
Nakano

(10) Patent No.: US 10,627,740 B2
(45) Date of Patent: Apr. 21, 2020

(54) IMAGE PROCESSING APPARATUS AND ABNORMALITY DETERMINATION METHOD

(71) Applicant: Kyocera Document Solutions Inc., Osaka (JP)

(72) Inventor: Ayumi Nakano, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 0 days.

(21) Appl. No.: 16/416,269

(22) Filed: May 20, 2019

(65) Prior Publication Data

US 2019/0354038 A1 Nov. 21, 2019

(30) Foreign Application Priority Data

May 21, 2018 (JP) ..... 2018-097129

(51) Int. Cl.
*G03G 15/00* (2006.01)
*G03G 15/08* (2006.01)

(52) U.S. Cl.
CPC ..... *G03G 15/0849* (2013.01); *G03G 15/556* (2013.01)

(58) Field of Classification Search
CPC ..... G03G 15/5041; G03G 15/553; G03G 15/5062
USPC ..... 399/15, 49
See application file for complete search history.

(56) References Cited

U.S. PATENT DOCUMENTS

| | | | | |
|---|---|---|---|---|
| 9,389,566 | B2 * | 7/2016 | Takahashi | G03G 15/5062 |
| 9,885,991 | B2 * | 2/2018 | Arimoto | G03G 15/553 |
| 10,365,601 | B2 * | 7/2019 | Sone et al. | G03G 15/5041 |
| 10,474,082 | B2 * | 11/2019 | Tomii | G03G 15/5062 |
| 2014/0112676 | A1 | 4/2014 | Mori | |
| 2015/0192884 | A1 | 7/2015 | Sone | |
| 2017/0219979 | A1 | 8/2017 | Arimoto | |

FOREIGN PATENT DOCUMENTS

JP 2016-142740 A 8/2016

* cited by examiner

*Primary Examiner* — William J Royer
(74) *Attorney, Agent, or Firm* — James Judge

(57) ABSTRACT

An image processing apparatus includes an image forming unit of an electrophotographic method, a detection processing unit, and a determination processing unit. The detection processing unit detects a streaky image along a sub-scanning direction from a first image and a second image among images indicated by image data. The first image has a print density equal to or more than a predetermined reference print-density value, and the second image has a print density less than the reference print-density value. The determination processing unit determines a cause of abnormality in the image forming unit based on a detection result of the streaky image by the detection processing unit for each of the first image and the second image.

8 Claims, 10 Drawing Sheets

IMAGE PROCESSING APPARATUS AND ABNORMALITY DETERMINATION METHOD

INCORPORATION BY REFERENCE

This application is based upon, and claims the benefit of priority from, corresponding Japanese Patent Application No. 2018-097129 filed in the Japan Patent Office on May 21, 2018, the entire contents of which are incorporated herein by reference.

BACKGROUND

Unless otherwise indicated herein, the description in this section is not prior art to the claims in this application and is not admitted to be prior art by inclusion in this section.

There has been known an image processing apparatus such as a printer that includes an image forming unit configured to form an image with an electrophotographic method. There has been known an image processing apparatus configured to form a predetermined inspection image to detect a failure in the image forming unit based on image data read from this inspection image.

SUMMARY

An image processing apparatus according to one aspect of the disclosure includes an image forming unit of an electrophotographic method, a detection processing unit, and a determination processing unit. The detection processing unit detects a streaky image along a sub-scanning direction from a first image and a second image among images indicated by image data. The first image has a print density equal to or more than a predetermined reference print-density value, and the second image has a print density less than the reference print-density value. The determination processing unit determines a cause of abnormality in the image forming unit based on a detection result of the streaky image by the detection processing unit for each of the first image and the second image.

These as well as other aspects, advantages, and alternatives will become apparent to those of ordinary skill in the art by reading the following detailed description with reference where appropriate to the accompanying drawings. Further, it should be understood that the description provided in this summary section and elsewhere in this document is intended to illustrate the claimed subject matter by way of example and not by way of limitation.

DETAILED DESCRIPTION

Figure 1:
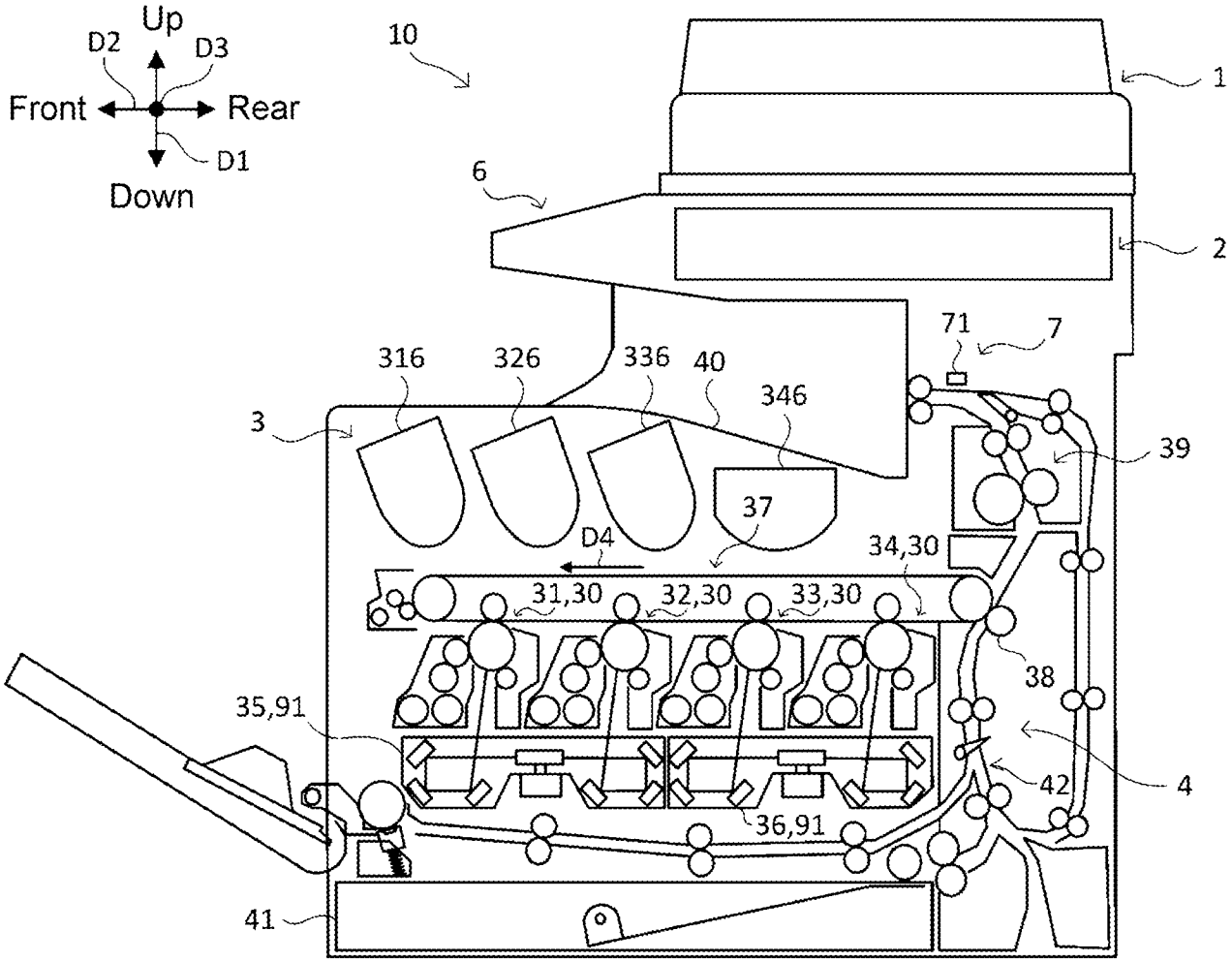
FIG. 1 illustrates a configuration of an image forming apparatus according to one embodiment of the disclosure.

Example apparatuses are described herein. Other example embodiments or features may further be utilized, and other changes may be made, without departing from the spirit or scope of the subject matter presented herein. In the following detailed description, reference is made to the accompanying drawings, which form a part thereof.

The example embodiments described herein are not meant to be limiting. It will be readily understood that the aspects of the present disclosure, as generally described herein, and illustrated in the drawings, can be arranged, substituted, combined, separated, and designed in a wide variety of different configurations, all of which are explicitly contemplated herein.

The following describes an embodiment of the disclosure with reference to the attached drawings. The following embodiment is one example of the embodied disclosure and does not limit a technical scope of the disclosure.

Configuration of Image Forming Apparatus 10

First, a description will be given of the configuration of an image forming apparatus 10 according to the embodiment of the disclosure with reference to FIGS. 1 and 2. Here, FIG. 1 illustrates a cross-sectional schematic diagram of the configuration of the image forming apparatus 10.

For convenience of explanation, in an installation state where the image forming apparatus 10 is usable (a state illustrated in FIG. 1), a vertical direction is defined as an up-down direction D1. A front-rear direction D2 is defined having a surface of the image forming apparatus 10 illustrated in FIG. 1 on a paper left side as a front (front face). A lateral direction D3 is defined having the front of the image forming apparatus 10 in the installation state as a reference.

The image forming apparatus 10 is a multi-functional peripheral that has a plurality of functions such as a facsimile function and a copy function in addition to a scan function that scans image data from an original document and a print function that forms an image based on the image data.

Figure 2:
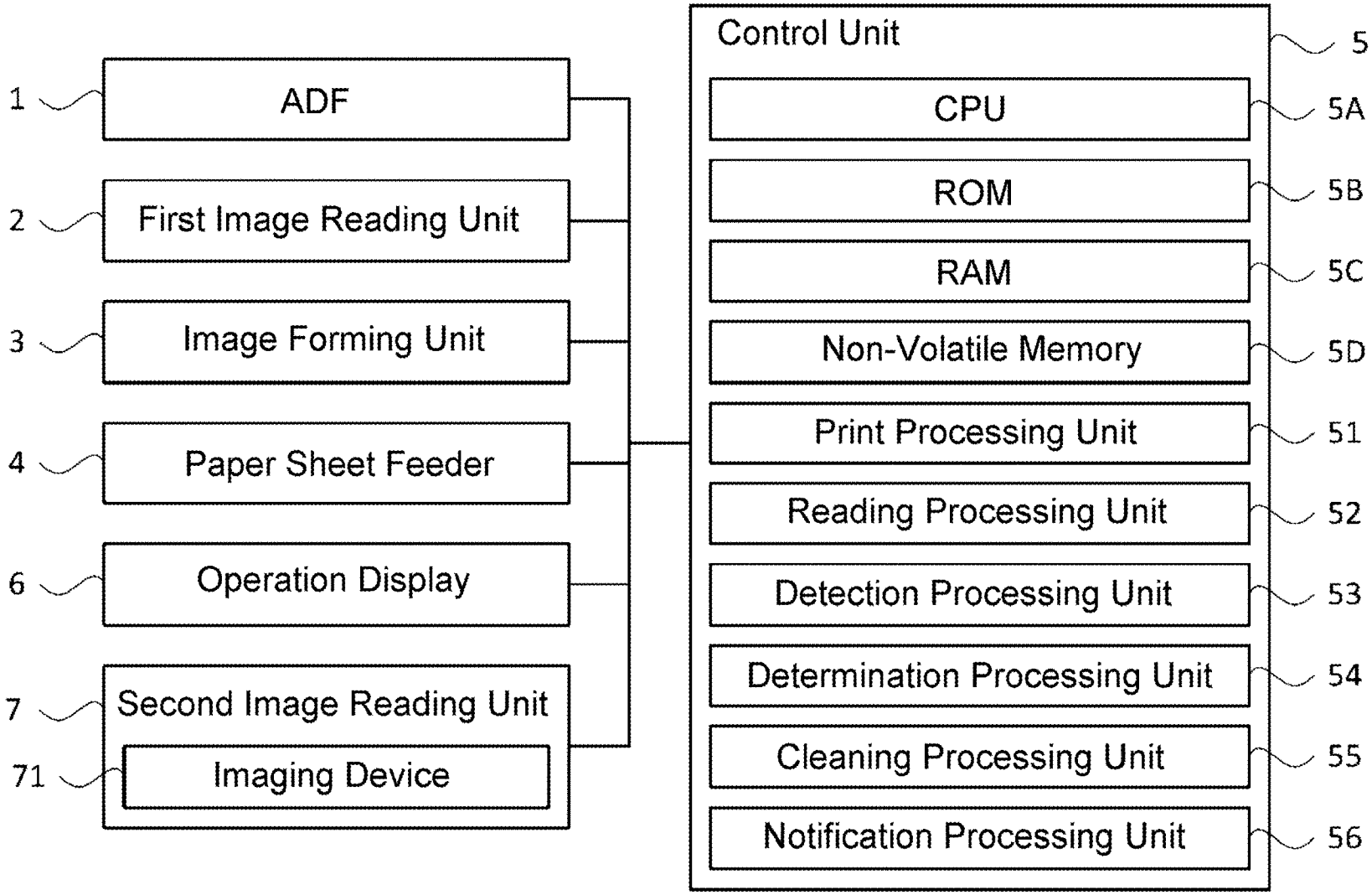
FIG. 2 illustrates a block diagram of a system configuration of the image forming apparatus according to the one embodiment.

As illustrated in FIGS. 1 and 2, the image forming apparatus 10 includes an automatic document feeder (ADF) 1, a first image reading unit 2, an image forming unit 3, a paper sheet feeder 4, a control unit 5, an operation display 6, and a second image reading unit 7. Here, the image forming apparatus 10 is an exemplary image processing apparatus in the disclosure. The image processing apparatus in the disclosure may be, for example, a scanner, a printing device, a facsimile device, a copying machine, and a personal computer that include the control unit 5.

The ADF 1 includes, for example, a document setting portion, a plurality of conveyance rollers, a document holder, and a paper sheet discharge unit, and feeds the original document read by the first image reading unit 2.

The first image reading unit 2 includes, for example, a platen, a light source, a plurality of mirrors, an optical lens, and a CCD, and can read the image data from the original document.

The image forming unit 3 can form the image on a sheet with an electrophotographic method based on the image data read by the first image reading unit 2. The image forming unit 3 can form the image on the sheet based on image data input from an external information processing device. The configuration of the image forming unit 3 will be described later in detail.

The paper sheet feeder 4 supplies the sheet to the image forming unit 3. As illustrated in FIG. 1, the paper sheet feeder 4 includes, for example, a sheet feed cassette 41, a sheet conveyance path 42, and a plurality of conveyance rollers. The sheet feed cassette 41 houses the sheet used for printing. For example, the sheet housed in the sheet feed cassette 41 is a sheet member such as paper, coated paper, a postcard, an envelope, and an OHP sheet. The sheet conveyance path 42 is a moving passage for the sheet formed between the sheet feed cassette 41 and a sheet discharge tray 40 of the image forming unit 3 (see FIG. 1). The plurality of conveyance rollers are located on the sheet conveyance path 42, and convey the sheet from the sheet feed cassette 41 to the sheet discharge tray 40.

As illustrated in FIG. 2, the control unit 5 includes control instruments such as a CPU 5A, a ROM 5B, a RAM 5C, and a non-volatile memory 5D. The CPU 5A is a processor that executes various arithmetic operations. The ROM 5B is a non-volatile storage device that preliminarily stores information such as a control program to cause the CPU 5A to execute various processes. The RAM 5C is a volatile storage device and used as a temporary memory (work area) of the various processes executed by the CPU 5A. The non-volatile memory 5D is a non-volatile storage device such as a flash memory and an EEPROM (registered trademark). In the control unit 5, the CPU 5A executes the various control programs preliminarily stored in the ROM 5B. This ensures integrated control of the image forming apparatus 10 by the control unit 5. The control unit 5 may include an electronic circuit such as an integrated circuit (ASIC), or may be a control unit separately located from a main control unit that integrally controls the image forming apparatus 10.

The operation display 6 includes a display such as a liquid crystal display and an operation unit such as operation keys or a touch panel. The display displays various kinds of information corresponding to a control instruction from the control unit 5. The various kinds of information are input to the control unit 5 via the operation unit corresponding to an operation by a user.

The second image reading unit 7 reads an image from a sheet fed by the paper sheet feeder 4 on a downstream side in a conveyance direction of the sheet by the paper sheet feeder 4 with respect to a fixing unit 39 (see FIG. 1) of the image forming unit 3 on the sheet conveyance path 42. As illustrated in FIGS. 1 and 2, the second image reading unit 7 includes an imaging device 71. The imaging device 71 is an image sensor such as a Contact Image Sensor (CIS) that includes a light emitting portion and a light receiving portion. The light emitting portion emits a light toward the sheet fed by the paper sheet feeder 4. The light receiving portion receives the light emitted from the light emitting portion and reflected by the sheet, and outputs an electrical signal corresponding to an amount of the received light. The second image reading unit 7 converts the electrical signal output from the light receiving portion of the imaging device 71 into a digital signal (image data) in an analog front-end circuit (not illustrated), and inputs the converted image data to the control unit 5.

Here, the second image reading unit 7 inputs the image data where pixel colors are expressed with values of R (red), G (green), and B (blue) to the control unit 5. For example, the second image reading unit 7 inputs the image data expressed with the R value, the G value, and the B value each having 256 tones of 0 to 255 to the control unit 5. In the following description, a color where the R value, the G value, and the B value are each 0 is assumed to be K (black).

Figure 3:
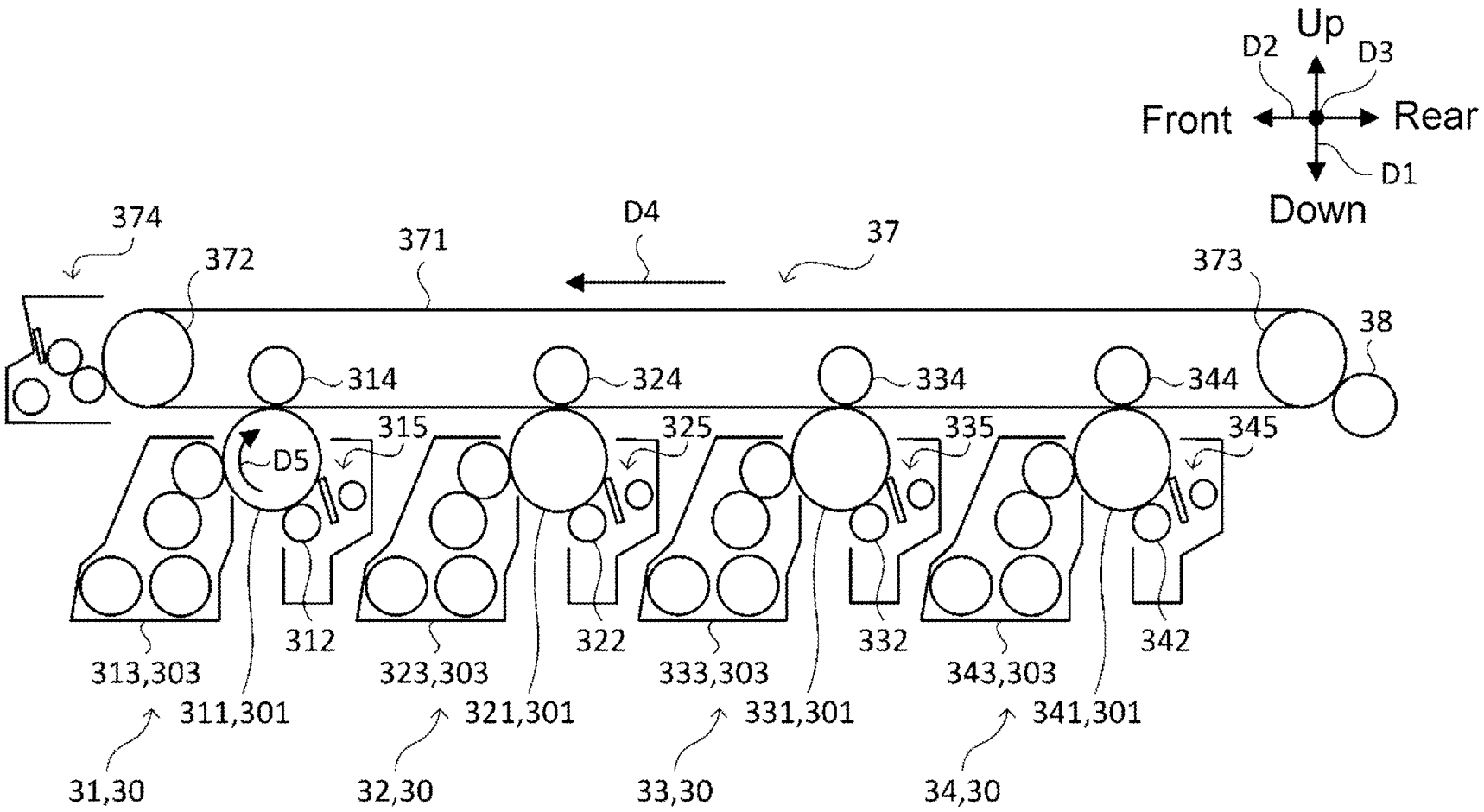
FIG. 3 illustrates a configuration of an image forming unit and an intermediate transfer apparatus of the image forming apparatus according to the one embodiment.

The second image reading unit 7 may read images (toner images) formed by respective image forming units 31 to 34 (see FIG. 1) on a surface of an intermediate transfer belt 371 (see FIG. 3). In this case, the imaging device 71 is located facing the surface of the intermediate transfer belt 371 at a position between the image forming unit 34 and a secondary transfer roller 38 in a rotation direction D4 of the intermediate transfer belt 371. The image forming apparatus 10 does not need to include the second image reading unit 7.

Configuration of Image Forming Unit 3

Next, the configuration of the image forming unit 3 will be described with reference to FIGS. 1 and 3. Here, FIG. 3 illustrates a cross-sectional schematic diagram of the configurations of the image forming units 31 to 34 and an intermediate transfer apparatus 37.

As illustrated in FIGS. 1 and 3, the image forming unit 3 includes the image forming units 31 to 34, light scanning devices 35 and 36, the intermediate transfer apparatus 37, the secondary transfer roller 38, the fixing unit 39, and the sheet discharge tray 40.

The image forming unit 31, the image forming unit 32, the image forming unit 33, and the image forming unit 34 are image forming units of an electrophotographic method that correspond to Y (yellow), C (cyan), M (magenta), and K (black), respectively. As illustrated in FIG. 3, the image forming units 31 to 34 are located side by side along the front-rear direction D2 of the image forming apparatus 10 in the order of yellow, cyan, magenta, and black from the front. Hereinafter, the image forming units 31 to 34 are generically referred to as an image forming unit 30 in some cases.

As illustrated in FIGS. 1 and 3, the image forming unit 31 includes a photoreceptor drum 311, a charging roller 312, a developing device 313, a primary transfer roller 314, a drum cleaning unit 315, and a toner container 316. The image forming unit 32 includes a photoreceptor drum 321, a charging roller 322, a developing device 323, a primary transfer roller 324, a drum cleaning unit 325, and a toner container 326. The image forming unit 33 includes a photoreceptor drum 331, a charging roller 332, a developing device 333, a primary transfer roller 334, a drum cleaning unit 335, and a toner container 336. The image forming unit 34 includes a photoreceptor drum 341, a charging roller 342, a developing device 343, a primary transfer roller 344, a drum cleaning unit 345, and a toner container 346. Hereinafter, the photoreceptor drum 311, the photoreceptor drum 321, the photoreceptor drum 331, and the photoreceptor drum 341 are generically referred to as a photoreceptor drum 301 in some cases. The developing device 313, the developing device 323, the developing device 333, and the developing device 343 are generically referred to as a developing device 303 in some cases.

The photoreceptor drum 311 carries an electrostatic latent image. The photoreceptor drum 311 has a rotation shaft extending in the lateral direction D3. The rotation shaft is rotatably supported by a unit housing (not illustrated) that houses the photoreceptor drum 311, the charging roller 312, and the drum cleaning unit 315. The photoreceptor drum 311 receives a rotary drive power supplied from a motor (not illustrated) to be rotated in a rotation direction D5 illustrated in FIG. 3. The photoreceptor drums 321, 331, and 341 are similar to the photoreceptor drum 311. Here, the photoreceptor drum 301 is one example of an image carrier in the disclosure.

The charging roller 312 is applied with voltage from a power source (not illustrated) to charge the surface of the photoreceptor drum 311 in a positive polarity. On the surface of the photoreceptor drum 311 charged by the charging roller 312, the electrostatic latent image is formed with a light emitted from the light scanning device 35. The charging rollers 322, 332, and 342 are similar to the charging roller 312.

The developing device 313 develops the electrostatic latent image formed on the surface of the photoreceptor drum 311. The developing device 313 includes a pair of stirring members, a magnet roller, and a developing roller. The pair of stirring members stir a developer containing a toner and a carrier housed in the developing device 313. Thus, the toner contained in the developer is charged in the positive polarity due to friction with the carrier contained in the developer. The magnet roller pumps up the developer stirred by the pair of stirring members to supply the toner contained in this developer to the surface of the developing roller. The developing roller is applied with voltage from the power source (not illustrated) to supply the toner attached to the surface to the photoreceptor drum 311. Thus, the electrostatic latent image formed on the surface of the photoreceptor drum 311 is developed. Therefore, a toner image is formed on the surface of the photoreceptor drum 311. The developing device 313 is supplied with the toner from the toner container 316. The developing devices 323, 333, and 343 are similar to the developing device 313. Here, the developing device 303 is one example of the developing unit in the disclosure.

The primary transfer roller 314 is applied with voltage in a negative polarity from the power source (not illustrated) to transfer the toner image formed on the surface of the photoreceptor drum 311 to the intermediate transfer belt 371 (see FIG. 2). The primary transfer rollers 324, 334, and 344 are similar to the primary transfer roller 314.

The drum cleaning unit 315 cleans the surface of the photoreceptor drum 311 after the toner image is transferred. The drum cleaning unit 315 includes a cleaning member and a conveying member. The cleaning member is formed in a blade shape, and removes the toner attached to the surface of the photoreceptor drum 311 from this surface. The conveying member conveys the toner removed by the cleaning member to a toner housing container (not illustrated). The drum cleaning units 325, 335, and 345 are similar to the drum cleaning unit 315.

The light scanning device 35 scans each of the photoreceptor drums 311 and 321 included in the image forming units 31 and 32 with a light based on the image data. This forms the electrostatic latent images on the respective photoreceptor drums 311 and 321. The light scanning device 36 scans each of the photoreceptor drums 331 and 341 included in the image forming units 33 and 34 with the light based on the image data. This forms the electrostatic latent images on the respective photoreceptor drums 331 and 341. Here, the light scanning device 35 and the light scanning device 36 are examples of a latent image formation unit in the disclosure. Hereinafter, the light scanning device 35 and the light scanning device 36 are generically referred to as a light scanning device 91 in some cases. The configuration of the light scanning device 35 will be described later in detail.

The intermediate transfer apparatus 37 uses the intermediate transfer belt 371 to convey the toner images transferred to the intermediate transfer belt 371 from the respective photoreceptor drums 311, 321, 331, and 341 included in the image forming units 31 to 34. As illustrated in FIG. 3, the intermediate transfer apparatus 37 includes the intermediate transfer belt 371, a drive roller 372, a suspension roller 373, and a belt cleaning unit 374. The intermediate transfer belt 371 is an endless belt member to which the toner images formed on the respective surfaces of the photoreceptor drums 311, 321, 331, and 341 are transferred. As illustrated in FIG. 3, the intermediate transfer belt 371 is stretched by the drive roller 372 and the suspension roller 373 separately arranged in the front-rear direction D2 of the image forming apparatus 10. The drive roller 372 receives the rotary drive power supplied from the motor (not illustrated) to be rotated. This rotates the intermediate transfer belt 371 in the rotation direction D4 illustrated in FIG. 3. The toner images transferred to the surface of the intermediate transfer belt 371 from the respective photoreceptor drums 311, 321, 331, and 341 are conveyed to the secondary transfer roller 38 in accordance with the rotation of the intermediate transfer belt 371. The belt cleaning unit 374 cleans the surface of the intermediate transfer belt 371 on the downstream side in the rotation direction D4 of the intermediate transfer belt 371 with respect to a transfer position of the toner image by the secondary transfer roller 38.

The secondary transfer roller 38 is applied with the voltage in the negative polarity from the power source (not illustrated) to transfer the toner images formed on the surface of the intermediate transfer belt 371 to the sheet supplied by the paper sheet feeder 4.

The fixing unit 39 fuses the toner image transferred to the sheet by the secondary transfer roller 38 on this sheet. The fixing unit 39 includes a fixing roller and a pressure roller. The fixing roller is located in contact with the pressure roller, and heats the toner image transferred to the sheet to fix it on this sheet. The pressure roller applies pressure to the sheet passing through a contact portion formed with the fixing roller.

Configuration of Light Scanning Device 35

Figure 4:
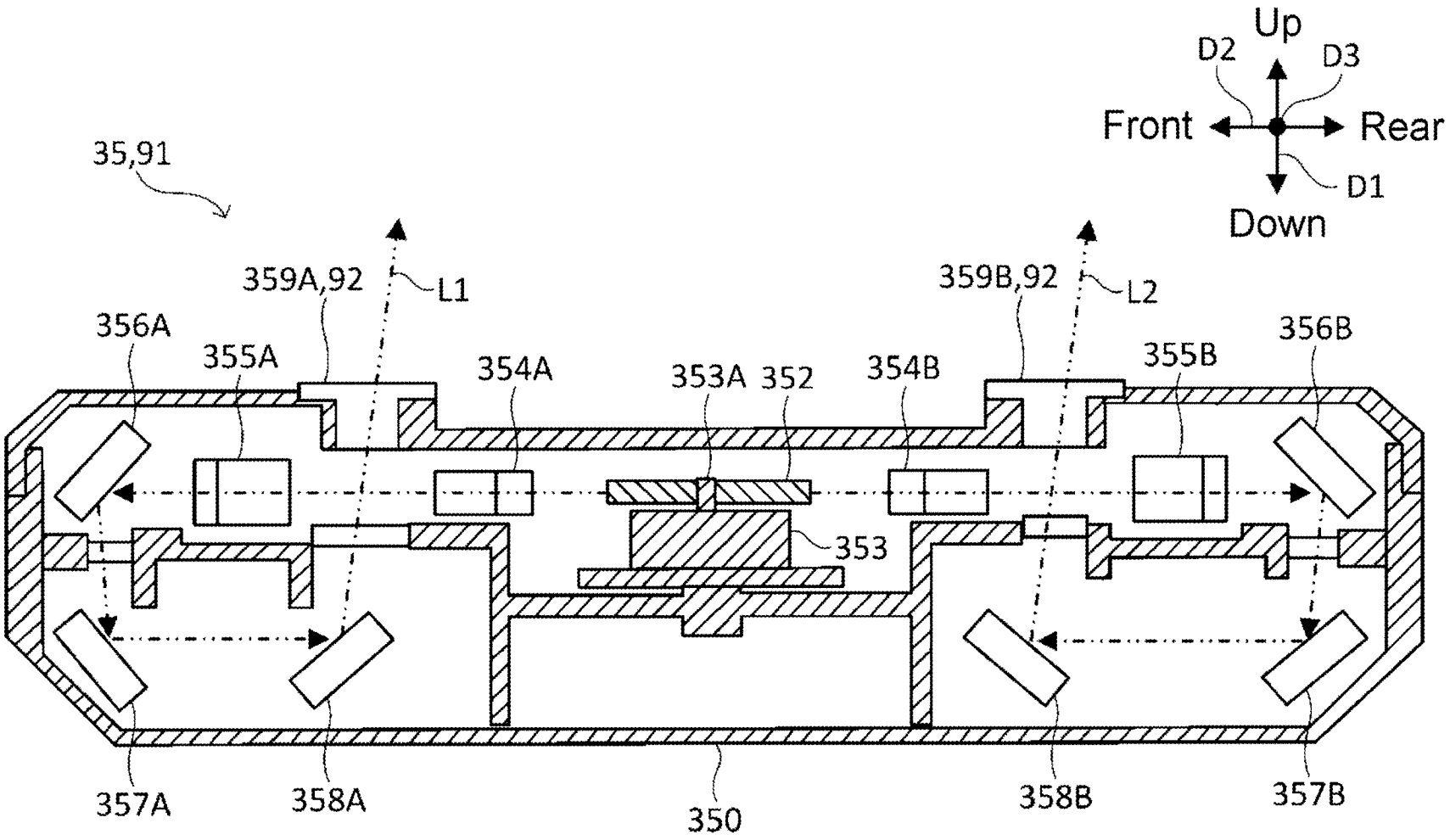
FIG. 4 illustrates a configuration of a light scanning device of the image forming apparatus according to the one embodiment.
Figure 5:
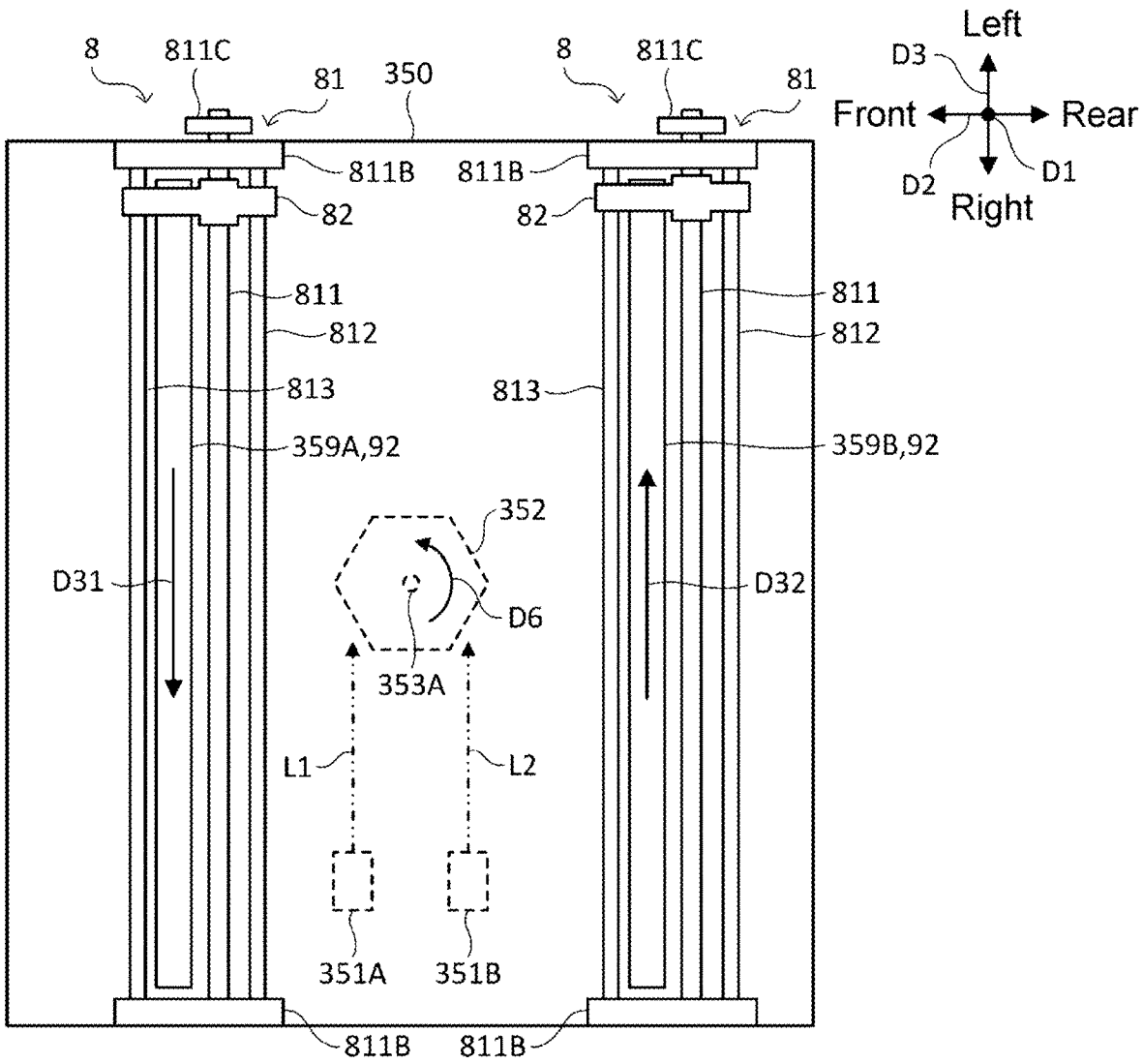
FIG. 5 illustrates the configuration of the light scanning device of the image forming apparatus according to the one embodiment.

Next, the configuration of the light scanning device 35 will be described with reference to FIGS. 4 and 5. Here, FIG. 4 illustrates a cross-sectional schematic diagram of the configuration of the light scanning device 35. FIG. 5 illustrates a plan view of a configuration of an upper portion of a housing 350. Two-dot chain lines in FIGS. 4 and 5 illustrate optical paths of lights L1 and L2 emitted from light sources 351A and 351B (see FIG. 5).

As illustrated in FIGS. 4 and 5, the light scanning device 35 includes the light sources 351A and 351B, a polygon mirror 352, a polygon motor 353, fθ lenses 354A and 354B, fθ lenses 355A and 355B, return mirrors 356A and 356B, return mirrors 357A and 357B, return mirrors 358A and 358B, and the housing 350 that houses these components. As illustrated in FIGS. 3 and 4, the housing 350 has light transmitting portions 359A and 359B. Since the light scanning device 36 is similarly configured, the explanations will be omitted here.

The light sources 351A and 351B emit the light corresponding to the image data. For example, the light sources 351A and 351B are laser diodes. The light source 351A emits the light L1 (see FIG. 4) that irradiates the photoreceptor drum 311 of the image forming unit 31. The light source 351B emits the light L2 (see FIG. 4) that irradiates the photoreceptor drum 321 of the image forming unit 32.

The polygon mirror 352 causes the lights emitted from the light sources 351A and 351B to scan. For example, as illustrated in FIG. 5, the polygon mirror 352 is formed in a regular hexagon shape in plan view, and has a plurality of reflecting surfaces that reflect the lights emitted from the respective light sources 351A and 351B.

The polygon motor 353 supplies the rotary drive power to the polygon mirror 352 to rotate the polygon mirror 352. As illustrated in FIG. 4, the polygon mirror 352 is located to be secured to a rotation shaft 353A of the polygon motor 353.

The polygon mirror 352 rotates around the rotation shaft 353A in a rotation direction D6 illustrated in FIG. 5 with the rotary drive power supplied from the polygon motor 353. Thus, the polygon mirror 352 causes the lights to scan with the respective reflecting surfaces in order in accordance with the rotation. Specifically, the polygon mirror 352 causes the light L1 emitted from the light source 351A to scan in a scanning direction D31 (rightward in the lateral direction D3) illustrated in FIG. 5. The polygon mirror 352 causes the light L2 emitted from the light source 351B to scan in a scanning direction D32 (leftward in the lateral direction D3) illustrated in FIG. 5. Hereinafter, the lateral direction D3 is referred to as a main-scanning direction D71 (see FIG. 8) in some cases. A direction perpendicular to the main-scanning direction D71 is referred to as a sub-scanning direction D72 (see FIG. 8) in some cases.

The fθ lens 354A, the fθ lens 355A, the return mirror 356A, the return mirror 357A, the return mirror 358A, and the light transmitting portion 359A are located corresponding to the light source 351A. The fθ lens 354A and the fθ lens 355A convert the light L1 scanned by the polygon mirror 352 at an equal angular velocity into a light scanned at a constant velocity along the scanning direction D31. The return mirror 356A, the return mirror 357A, and the return mirror 358A guide the light L1 that has passed the fθ lens 354A and the fθ lens 355A to the light transmitting portion 359A.

Meanwhile, the fθ lens 354B, the fθ lens 355B, the return mirror 356B, the return mirror 357B, the return mirror 358B, and the light transmitting portion 359B are located corresponding to the light source 351B. The fθ lens 354B and the fθ lens 355B convert the light L2 scanned by the polygon mirror 352 at an equal angular velocity into a light scanned at a constant velocity along the scanning direction D32. The return mirror 356B, the return mirror 357B, and the return mirror 358B guide the light L2 that has passed the fθ lens 354B and the fθ lens 355B to the light transmitting portion 359B.

The lights scanned by the polygon mirror 352 transmit through the light transmitting portions 359A and 359B. The light transmitting portions 359A and 359B are transparent members formed on the upper portion of the housing 350 and long in the lateral direction D3 to cover openings. For example, the light transmitting portions 359A and 359B are glass boards or acrylic boards. The light L1 transmitted through the light transmitting portion 359A is emitted to the photoreceptor drum 311 of the image forming unit 31. The light L2 transmitted through the light transmitting portion 359B is emitted to the photoreceptor drum 321 of the image forming unit 32. Hereinafter, the light transmitting portions 359A and 359B are generically referred to as a light transmitting portion 92 in some cases.

Here, in the light scanning device 35, a foreign object such as scattered toner particles possibly attaches to the light transmitting portion 359A and 359B to reduce amounts of the lights L1 and L2 emitted from the light transmitting portions 359A and 359B. Therefore, the light scanning device 35 includes two cleaning mechanisms 8 corresponding to the light transmitting portions 359A and 359B.

Configuration of Cleaning Mechanism 8

Figure 6:
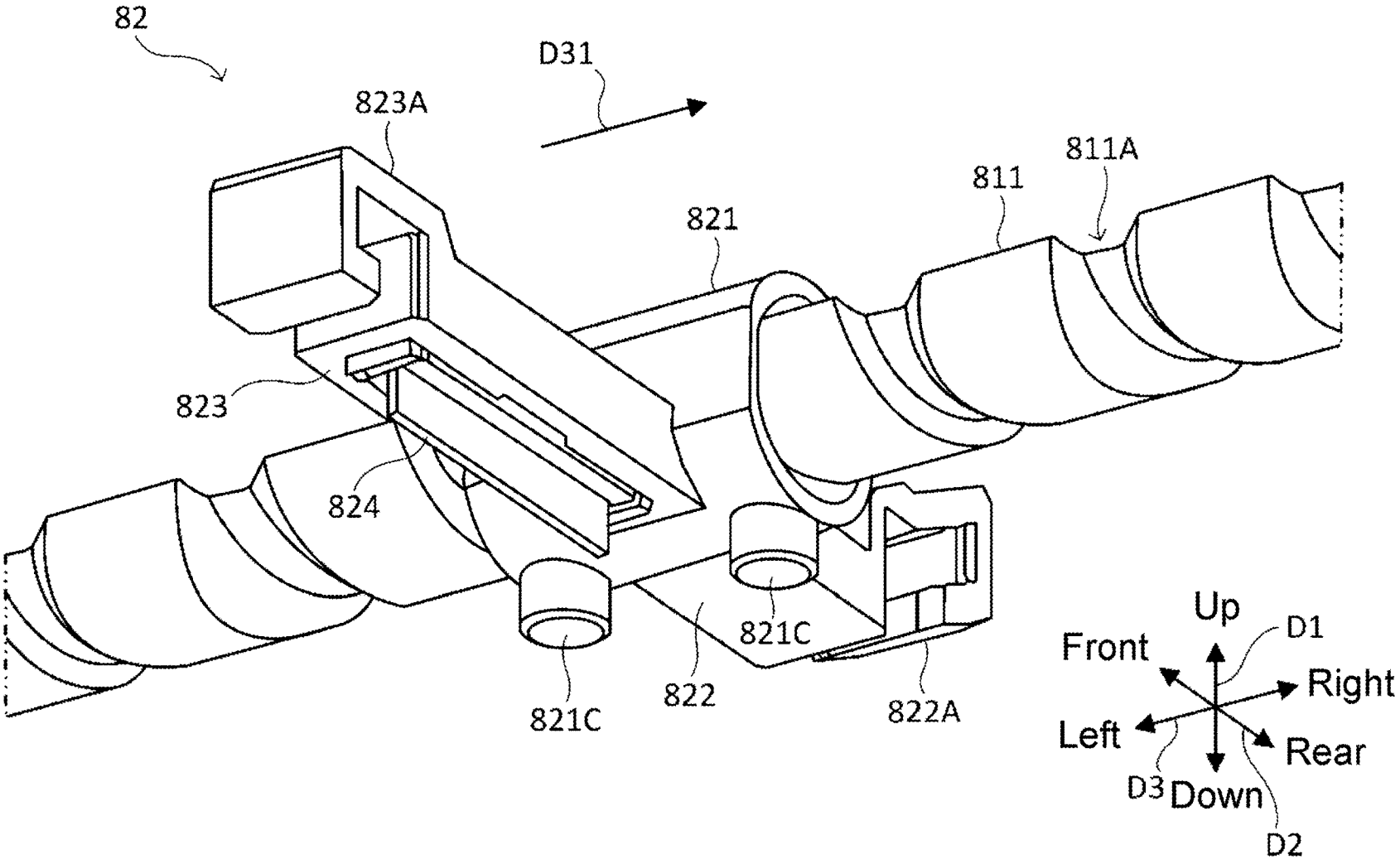
FIG. 6 illustrates a configuration of a cleaning mechanism of the image forming apparatus according to the one embodiment.
Figure 7:
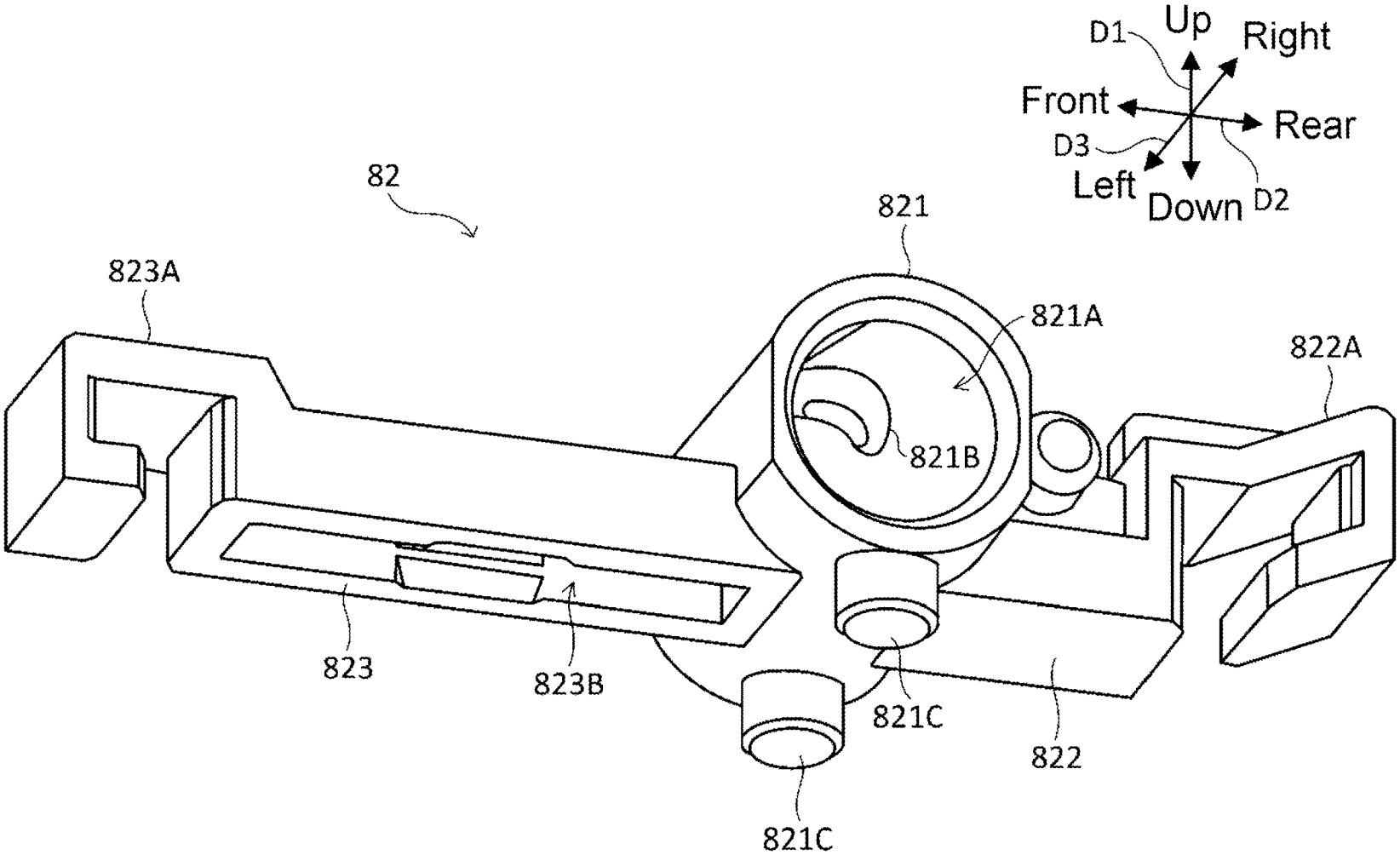
FIG. 7 illustrates a configuration of a cleaning unit of the image forming apparatus according to the one embodiment.

Next, the configuration of the cleaning mechanism 8 will be described with reference to FIGS. 5 to 7. Here, FIG. 6 obliquely illustrates the configuration of a cleaning unit 82 in a state of being supported by a screw shaft 811. FIG. 7 obliquely illustrates the configuration of the cleaning unit 82 in a state of being removed from the screw shaft 811. FIG. 7 illustrates the cleaning unit 82 where a contact portion 824 is removed.

Here, the two cleaning mechanisms 8 each have identical components. Therefore, the following describes only the cleaning mechanism 8 corresponding to the light transmitting portion 359A, and the description on the cleaning mechanism 8 corresponding to the light transmitting portion 359B will be omitted.

The cleaning mechanism 8 is located on the top surface of the housing 350, and cleans the surface of the light transmitting portion 359A. As illustrated in FIG. 5, the cleaning mechanism 8 includes a supporting unit 81 and the cleaning unit 82.

The supporting unit 81 movably supports the cleaning unit 82 along the lateral direction D3. As illustrated in FIG. 5, the supporting unit 81 includes the screw shaft 811 and guiding portions 812 and 813.

The screw shaft 811 supports the cleaning unit 82 and supplies a driving power to the cleaning unit 82 for the movement along the lateral direction D3. As illustrated in FIG. 6, the screw shaft 811 is a shaft member having a spiral groove 811A on an outer surface. The screw shaft 811 is rotatably supported by a bearing portion 811B (see FIG. 5) located on the top of the housing 350. The screw shaft 811 receives the rotary drive power from the motor (not illustrated) via a gear 811C (see FIG. 5) located on one end in the longitudinal direction.

The guiding portions 812 and 813 support the cleaning unit 82 and guide the cleaning unit 82 along the lateral direction D3. For example, the guiding portions 812 and 813 are columnar members. As illustrated in FIG. 5, the guiding portions 812 and 813 are arranged so as to sandwich the screw shaft 811 in the front-rear direction D2. The guiding portions 812 and 813 have both end portions supported by the bearing portions 811B. The guiding portions 812 and 813 may be integrally formed with the housing 350 on the top of the housing 350.

The cleaning unit 82 is movably located along the lateral direction D3 in a state of contacting the light transmitting portion 359A. As illustrated in FIGS. 6 and 7, the cleaning unit 82 includes a bearing portion 821, a first arm 822, a second arm 823, and the contact portion 824.

As illustrated in FIG. 7, the bearing portion 821 is formed in a pipe shape. The bearing portion 821 is integrally formed with the first arm 822 and the second arm 823. As illustrated in FIG. 7, the bearing portion 821 has a shaft hole 821A through which the screw shaft 811 is inserted. A protrusion 821B (see FIG. 7) engageable with the groove 811A of the screw shaft 811 is located inside the shaft hole 821A. The bearing portion 821 has projecting portions 821C projecting downward. The projecting portions 821C are inserted into a groove (not illustrated) formed on the top of the housing 350 along the lateral direction D3. Thus, the moving direction of the cleaning unit 82 is regulated in the lateral direction D3.

The first arm 822 is located projecting rearward from an outer peripheral surface of the bearing portion 821. As illustrated in FIG. 7, the first arm 822 has a distal end in the projection direction where a clasp unit 822A configured to clasp the guiding portion 812 is formed. Clasp of the guiding portion 812 by the clasp unit 822A regulates turning of the cleaning unit 82 around the screw shaft 811.

The second arm 823 is located projecting from the outer peripheral surface of the bearing portion 821 in a direction opposite to the projection direction of the first arm 822. As illustrated in FIG. 7, the second arm 823 has a distal end in the projection direction where a clasp unit 823A configured to clasp the guiding portion 813 is formed. Clasp of the guiding portion 813 by the clasp unit 823A regulates turning of the cleaning unit 82 around the screw shaft 811. The second arm 823 includes a mounting portion 823B (see FIG. 7) to which the contact portion 824 is removably attachable. The mounting portion 823B is located at a position facing the light transmitting portion 359A on a lower surface of the second arm 823.

The contact portion 824 is located contacting the surface of the light transmitting portion 359A. For example, the contact portion 824 is a plate-shaped elastic member. The contact portion 824 is installed to the mounting portion 823B of the second arm 823, thus being mounted to the cleaning unit 82. The contact portion 824 may be a brush-shaped member.

In the cleaning mechanism 8, the rotary drive power supplied from the motor (not illustrated) rotates the screw shaft 811, this causes the protrusion 821B of the bearing portion 821 to be guided to the groove 811A of the screw shaft 811, and then, the cleaning unit 82 moves along an axial direction of the screw shaft 811. This moves the contact portion 824 contacting the surface of the light transmitting portion 359A in the lateral direction D3, thus cleaning the top surface of the light transmitting portion 359A.

Incidentally, the image forming apparatus 10 possibly has a failure where a streaky image Y (see FIG. 8) along the sub-scanning direction D72 appears on the image formed by the image forming unit 3. Specifically, the streaky image Y is an image having a print density lighter than that of the peripheral area, and referred to as white streaks. This failure occurs due to any of the components of the image forming unit 3. Here, a typical image processing apparatus requires a human to identify a point of the image forming unit 3 causing the streaky image Y and deal with it corresponding to the identified point. In contrast, as described below, the image forming apparatus 10 according to the embodiment of the disclosure ensures reduction of the labor to identify the cause of the occurrence of the streaky image Y.

Specifically, the ROM 5B of the control unit 5 preliminarily stores an abnormality determination program to cause the CPU 5A of the control unit 5 to execute an abnormality determination process (see flowchart of FIG. 10) described below. The abnormality determination program may be recorded in a computer readable recording medium such as a CD, a DVD, and a flash memory, and read from the recording medium to be installed in the non-volatile memory 5D.

Then, as illustrated in FIG. 2, the control unit 5 includes a print processing unit 51, a reading processing unit 52, a detection processing unit 53, a determination processing unit 54, a cleaning processing unit 55, and a notification processing unit 56. Specifically, the control unit 5 uses the CPU 5A to execute the abnormality determination program stored in the ROM 5B. Thus, the control unit 5 functions as the print processing unit 51, the reading processing unit 52, the detection processing unit 53, the determination processing unit 54, the cleaning processing unit 55, and the notification processing unit 56.

The print processing unit 51 uses the image forming unit 3 and the paper sheet feeder 4 to print a predetermined inspection image X100 (see FIG. 8) on the sheet.

Figure 8:
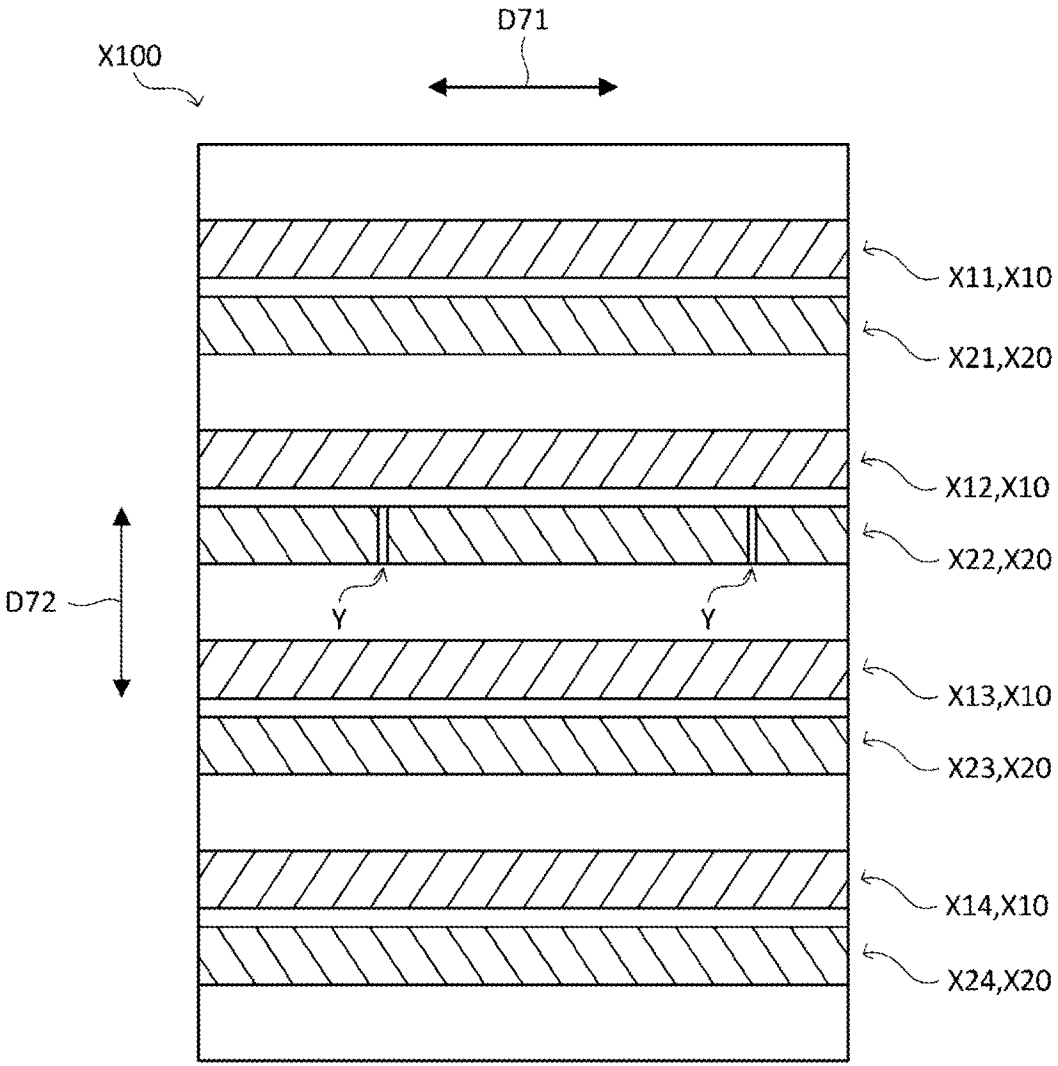
FIG. 8 illustrates an exemplary inspection image printed by the image forming apparatus according to the one embodiment.

Here, the inspection image X100 will be described with reference to FIG. 8. FIG. 8 illustrates the exemplary inspection image X100 printed by the print processing unit 51 in the image forming apparatus 10. In FIG. 8, first images X11 to X14 and second images X21 to X24 are hatched.

The inspection image X100 is an image used for determining whether the failure of appearance of the streaky image Y in the image forming unit 3 has occurred or not. The inspection image X100 is an image used for identifying the cause of the failure when this failure of appearance of the streaky image Y in the image forming unit 3 is determined to have occurred.

The inspection image X100 includes first images X10 and second images X20 corresponding to each print color of the image forming unit 3. Specifically, as illustrated in FIG. 8, the inspection image X100 includes the first image X11 and the second image X21 corresponding to K (black). The inspection image X100 includes the first image X12 and the second image X22 corresponding to C (cyan). The inspection image X100 includes the first image X13 and the second image X23 corresponding to M (magenta). The inspection image X100 includes the first image X14 and the second image X24 corresponding to Y (yellow).

Here, the first images X10 are images where print densities of the colors corresponding to these first images X10 are equal to or more than predetermined reference print-density values. As illustrated in FIG. 8, the first images X10 are strip-shaped images having predetermined widths in the sub-scanning direction D72 and long in the main-scanning direction D71. The second images X20 are images where the print densities of the colors corresponding to these second images X20 are less than the reference print-density values. That is, the second images X20 are images light in print densities of the corresponding colors compared with the first images X10 having these colors in common. As illustrated in FIG. 8, similarly to the first images X10, the second images X20 are strip-shaped images having predetermined widths in the sub-scanning direction D72 and long in the main-scanning direction D71.

For example, the first image X11 is an image where the print density of K (black) is 100 percent and the respective print densities of C (cyan), M (magenta), and Y (yellow) are 0 percent. In other words, the first image X11 is a solid image of K (black). The second image X21 is an image where the print density of K (black) is 40 percent and the respective print densities of C (cyan), M (magenta), and Y (yellow) are 0 percent. In other words, the second image X21 is a halftone image of K (black).

The first image X12 is an image where the print density of C (cyan) is 100 percent and the respective print densities of K (black), M (magenta), and Y (yellow) are 0 percent. In other words, the first image X12 is a solid image of C (cyan). The second image X22 is an image where the print density of C (cyan) is 40 percent and the respective print densities of K (black), M (magenta), and Y (yellow) are 0 percent. In other words, the second image X22 is a halftone image of C (cyan).

The first image X13 is an image where the print density of M (magenta) is 100 percent, and the respective print densities of C (cyan), K (black), and Y (yellow) are 0 percent. In other words, the first image X13 is a solid image of M (magenta). The second image X23 is an image where the print density of M (magenta) is 40 percent, and the respective print densities of C (cyan), K (black), and Y (yellow) are 0 percent. In other words, the second image X23 is a halftone image of M (magenta).

The first image X14 is an image where the print density of Y (yellow) is 100 percent, and the respective print densities of C (cyan), M (magenta), and K (black) are 0 percent. In other words, the first image X14 is a solid image of Y (yellow). The second image X24 is an image where the print density of Y (yellow) is 40 percent, and the respective print densities of C (cyan), M (magenta), and K (black) are 0 percent. In other words, the second image X24 is a halftone image of Y (yellow).

For example, in the image forming apparatus 10, inspection image data corresponding to the inspection image X100 is preliminarily stored in the ROM 5B. The print processing unit 51 prints the inspection image X100 on the sheet based on the inspection image data stored in the ROM 5B.

The first image X11 may be an image where the print density of K (black) is equal to or more than the reference print-density value and less than 100 percent, and the respective print densities of C (cyan), M (magenta), and Y (yellow) are 0 percent. The first images X12 to X14 may be similar to the first image X11. The second image X21 may be an image where the print density of K (black) exceeds a print density value of K (black) in the streaky image Y and less than the reference print-density value, and the respective print densities of C (cyan), M (magenta), and Y (yellow) are 0 percent. The second images X22 to X24 may be similar to the second image X21. A method for setting the reference print-density value will be described later.

The inspection image X100 may include an image used for detecting a failure of appearance of an abnormal image different from the streaky image Y in the image forming unit 3.

The reading processing unit 52 uses the second image reading unit 7 to read the image data from the sheet on which the inspection image X100 is printed by the print processing unit 51.

The reading processing unit 52 may use the first image reading unit 2 to read the image data from the sheet on which the inspection image X100 is printed. For example, when the print processing unit 51 has printed the inspection image X100 on the sheet, the reading processing unit 52 may cause the operation display 6 to display a message to prompt scanning this sheet. Then, the reading processing unit 52 may execute the reading process of the image data using the first image reading unit 2 corresponding to the operation by the user on the operation display 6.

The detection processing unit 53 detects the streaky image Y from the image data read by the reading processing unit 52.

Specifically, first, the detection processing unit 53 detects the first images X10 and the second images X20 corresponding to the respective print colors of the image forming unit 3 from the image data read by the reading processing unit 52.

For example, the detection processing unit 53 detects the first images X11 to X14 and the second images X21 to X24 from the image data read by the reading processing unit 52 based on respective positions of the first images X11 to X14 and the second images X21 to X24 in the inspection image data.

The detection processing unit 53 may detect the first images X11 to X14 and the second images X21 to X24 based on respective RGB values of pixels included in the image data read by the reading processing unit 52. For example, when the detection processing unit 53 detects a region where a width in the sub-scanning direction D72 and a color are identical to those of the second image X22 and a length in the main-scanning direction D71 is equal to or more than a predetermined distance, this region is determined to be a part of the second image X22.

Then, the detection processing unit 53 detects the streaky image Y for each of the first images X10 and the second images X20 corresponding to the respective detected colors.

Specifically, the detection processing unit 53 determines the existence and the position of the streaky image Y in the first image X10 based on the existence of a print density transition along the main-scanning direction D71 in this first image X10. The detection processing unit 53 determines the existence and the position of the streaky image Y in the second image X20 based on the existence of the print density transition along the main-scanning direction D71 in this second image X20.

For example, the detection processing unit 53 extracts any one line among a plurality of lines (pixel rows) along the main-scanning direction D71 included in the first image X12. Next, the detection processing unit 53 executes a binarization process using a predetermined first threshold value on a value of a complementary color (red) of the color (cyan) corresponding to the first image X12 among the respective RGB values of the pixels included in the extracted line. For example, the first threshold value is 120. Then, when a region where the value of the complementary color is 1 exists on the line after the binarization process, the detection processing unit 53 determines that the first image X12 includes the streaky image Y. The detection processing unit 53 determines that the streaky image Y resides on the region where the value of the complementary color is 1 on the line after the binarization process. The first threshold value may be any value higher than the R value in the first image X12 and lower than the R value of the streaky image Y that appears on the first image X12.

The detection processing unit 53 extracts any one line among a plurality of lines along the main-scanning direction D71 included in the second image X22. Next, the detection processing unit 53 executes the binarization process using a predetermined second threshold value on a value of a complementary color (red) of the color (cyan) corresponding to the second image X22 among the respective RGB values of the pixels included in the extracted line. For example, the second threshold value is 200. Then, when a region where the value of the complementary color is 1 exists on the line after the binarization process, the detection processing unit 53 determines that the second image X22 includes the streaky image Y. The detection processing unit 53 determines that the streaky image Y resides on the region where the value of the complementary color is 1 on the line after the binarization process. The second threshold value may be any value higher than the R value in the second image X22 and lower than the R value of the streaky image Y that appears on the second image X22.

Figure 9:
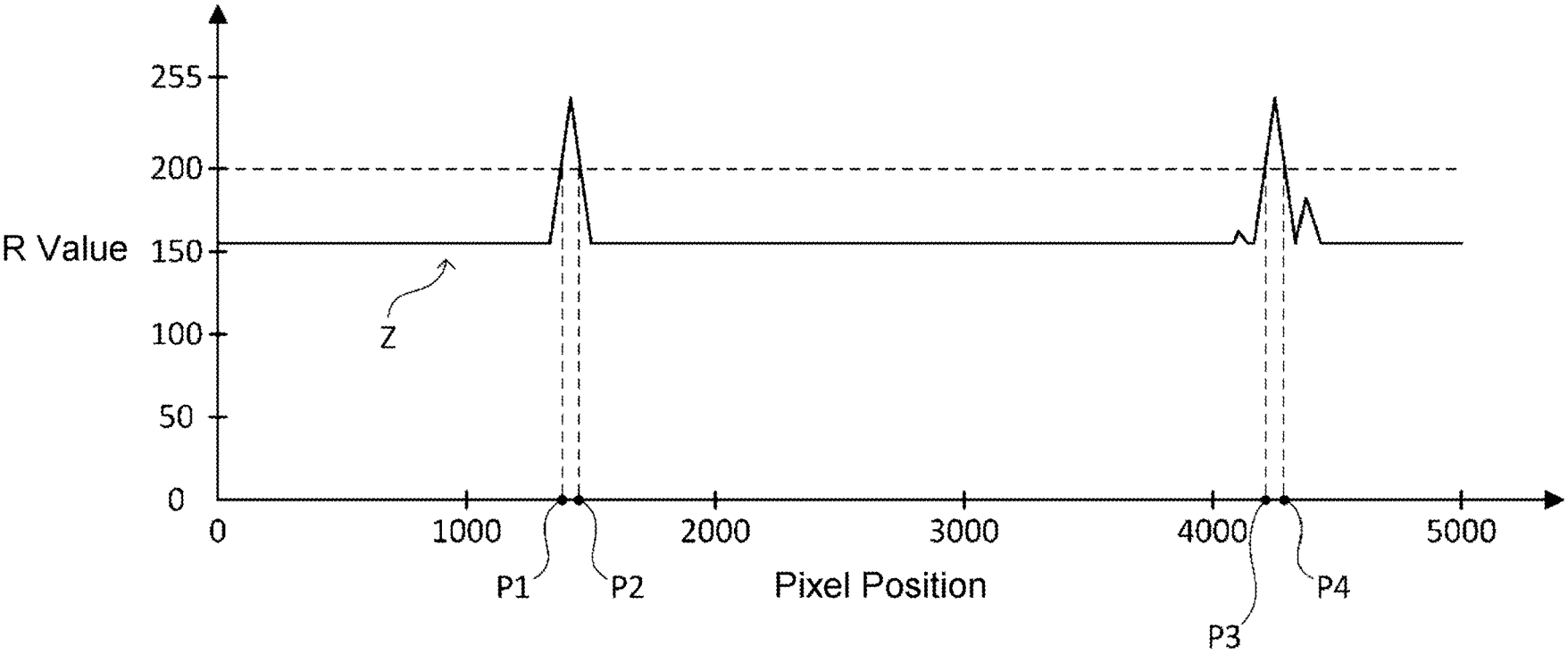
FIG. 9 illustrates a drawing describing a processing item by a detection processing unit of the image forming apparatus according to the one embodiment.

Here, FIG. 9 illustrates a line Z as an exemplary one line along the main-scanning direction D71 extracted from the second image X22 by the detection processing unit 53. In FIG. 9, the horizontal axis indicates respective pixel positions in the main-scanning direction D71 for the pixels included in the line Z. The vertical axis in FIG. 9 indicates the R values of the pixels included in the line Z.

As illustrated in FIG. 9, on the line Z, the respective R values of the pixels included in a region from a pixel position P1 to a pixel position P2 exceed the second threshold value of 200. Therefore, the detection processing unit 53 determines that the region from the pixel position P1 to the pixel position P2 includes the streaky image Y. As illustrated in FIG. 9, on the line Z, the respective R values of the pixels included in a region from a pixel position P3 to a pixel position P4 exceed the second threshold value of 200. Therefore, the detection processing unit 53 determines that the region from the pixel position P3 to the pixel position P4 includes the streaky image Y.

The detection processing unit 53 may calculate an average value of the R values of the pixels included in the respective lines along the sub-scanning direction D72 included in the first image X12 instead of extracting the one line from the first image X12. The detection processing unit 53 may calculate an average value of the R values of the pixels included in the respective lines along the sub-scanning direction D72 included in the second image X22 instead of extracting the one line from the second image X22.

The detection processing unit 53 determines the existence and the position of the streaky image Y for each of the first image X11, the first image X13, and the first image X14 with the procedure similar to that of the first image X12. In determining the existence and the position of the streaky image Y in the first image X11, the detection processing unit 53 may execute the binarization process using the first threshold value on the value of any one color among the RGB values of the respective pixels included in the line extracted from the first image X11.

The detection processing unit 53 determines the existence and the position of the streaky image Y for each of the second image X21, the second image X23, and the second image X24 with the procedure similar to that of the second image X22. In determining the existence and the position of the streaky image Y in the second image X21, the detection processing unit 53 may execute the binarization process using the second threshold value on the value of any one color among the RGB values of the respective pixels included in the line extracted from the second image X21.

The detection processing unit 53 can detect a gradient of print density transition in an outer circumference of the streaky image Y. Here, the outer circumference of the streaky image Y means the end position of the streaky image Y detected by the detection processing unit 53. For example, the outer circumference of the streaky image Y illustrated on the paper left side of FIG. 8 includes the pixel positions P1 and P2 illustrated in FIG. 9.

For example, the detection processing unit 53 detects a difference in print density between two pixels located on both sides of the pixel existing at the pixel position P1 as the gradient of print density transition in the outer circumference of the streaky image Y illustrated on the paper left side of FIG. 8.

The detection processing unit 53 may detect a difference between a lower-limit value and an upper-limit value of the print density in a region that includes the pixel position P1 and has a predetermined count of pixels as the gradient of print density transition in the outer circumference of the streaky image Y. The detection processing unit 53 may detect an average value of the difference in print density between the two pixels located on both sides of the pixel existing at the pixel position P1 and a difference in print density between two pixels located on both sides of the pixel existing at the pixel position P2 as the gradient of print density transition in the outer circumference of the streaky image Y.

The determination processing unit 54 determines the cause of abnormality in the image forming unit 3 based on the presence or absence of the streaky image Y detected by the detection processing unit 53 in each of the first image X10 and the second image X20 and the gradient of the print density transition in the outer circumference of the streaky image Y.

Specifically, the determination processing unit 54 identifies the developing device 303 corresponding to a print color as the cause of abnormality when the streaky image Y is detected in both the first image X10 and the second image X20 having this print color in common.

The determination processing unit 54 identifies the photoreceptor drum 301 corresponding to a print color as the cause of abnormality when the streaky image Y is detected in only the second image X20 among the first image X10 and the second image X20 having this print color in common and the gradient of the print density transition in the outer circumference of this streaky image Y is equal to or more than a predetermined third threshold value (an exemplary threshold value in the disclosure).

The determination processing unit 54 identifies the light scanning device 91 that forms the electrostatic latent image on the photoreceptor drum 301 corresponding to a print color as the cause of abnormality when the streaky image Y is detected in only the second image X20 among the first image X10 and the second image X20 having this print color in common and the gradient of the print density transition in the outer circumference of this streaky image Y is less than the third threshold value.

Here, the third threshold value can be determined based on the gradient of the print density transition in the outer circumference of the streaky image Y when the cause resides on the photoreceptor drum 301 and the gradient of the print density transition in the outer circumference of the streaky image Y when the cause resides on the light scanning device 91 with the cause of the occurrence of the streaky image Y artificially produced in the photoreceptor drum 301 and the light scanning device 91. For example, the streaky image Y can be generated by winding lint around the outer periphery of the photoreceptor drum 301. The streaky image Y can be generated by attaching a foreign object such as a toner on the light transmitting portion 92 of the light scanning device 91.

The reference print-density value can be determined based on an appearance state of the streaky image Y in each of a plurality of inspection images X100 with the cause of the occurrence of the streaky image Y artificially produced in the photoreceptor drum 301 or the light scanning device 91 and use of the image forming apparatus 10 in this state to print these respective plurality of inspection images X100 having different print densities of the first image X10.

The determination that the cause of abnormality resides on the developing device 303 corresponding to a print color when the streaky image Y is detected in both the first image X10 and the second image X20 having this print color in common is based on an empirical rule for the applicant. The determination that the cause of abnormality resides on the photoreceptor drum 301 corresponding to a print color when the streaky image Y is detected in only the second image X20 among the first image X10 and the second image X20 having this print color in common and the gradient of the print density transition in the outer circumference of this streaky image Y is large (the streaky image Y has a clear contour) is based on the empirical rule for the applicant. The determination that the cause of abnormality resides on the light scanning device 91 that forms the electrostatic latent image on the photoreceptor drum 301 corresponding to a print color when the streaky image Y is detected in only the second image X20 among the first image X10 and the second image X20 having this print color in common and the gradient of the print density transition in the outer circumference of this streaky image Y is small (the streaky image Y has a blurred contour) is based on the empirical rule for the applicant.

The determination processing unit 54 may determine the cause of abnormality in the image forming unit 3 based on only the presence or absence of the streaky image Y detected by the detection processing unit 53 in each of the first image X10 and the second image X20. In this case, the detection processing unit 53 does not need to detect the gradient of the print density transition in the outer circumference of the streaky image Y.

When the determination processing unit 54 determines the light scanning device 91 as the cause of abnormality, the cleaning processing unit 55 cleans the light transmitting portion 92 that transmits the light irradiating the photoreceptor drum 301 of the print color corresponding to the second image X20 where the streaky image Y has occurred.

Specifically, the cleaning processing unit 55 uses the cleaning mechanism 8 corresponding to the light transmitting portion 92 as a cleaning target to clean this light transmitting portion 92.

The notification processing unit 56 notifies the determination result by the determination processing unit 54.

For example, when the determination processing unit 54 determines that there is no cause of abnormality, the notification processing unit 56 causes the operation display 6 to display a first message indicating the fact. When the determination processing unit 54 determines that there is a cause of abnormality, the notification processing unit 56 causes the operation display 6 to display a second message that includes the fact, the cause of abnormality identified by the determination processing unit 54, and information indicating the position of the streaky image Y identified by the detection processing unit 53. In the case where the detection processing unit 53 detects the streaky image Y, when the determination processing unit 54 cannot identify the cause of abnormality, the notification processing unit 56 may cause a message indicating the fact to be displayed.

The control unit 5 may omit any one of the cleaning processing unit 55 and the notification processing unit 56.

Abnormality Determination Process

Figure 10:
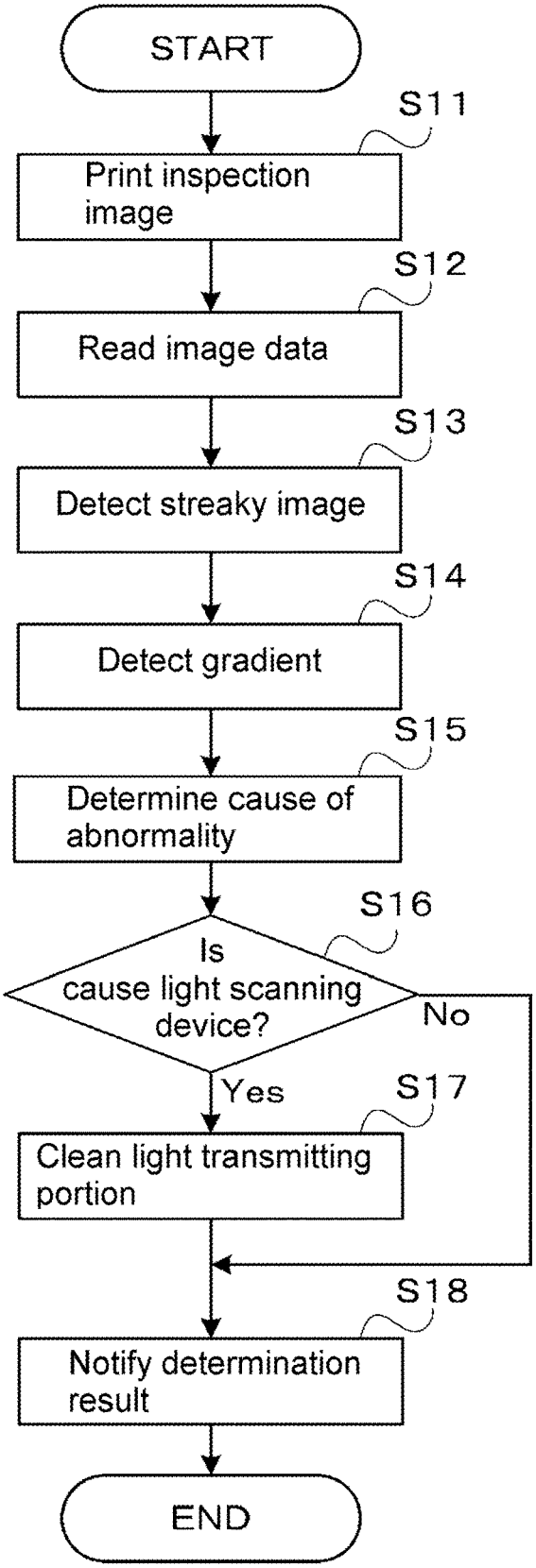
FIG. 10 illustrates an exemplary abnormality determination process executed by the image forming apparatus according to the one embodiment.

The following describes an exemplary procedure of the abnormality determination process executed by the control unit 5 in the image forming apparatus 10 with reference to FIG. 10. Here, Steps S11, S12, . . . indicate numbers of procedure (Step) executed by the control unit 5. The abnormality determination process is executed when an operation to instruct the execution of the abnormality determination process is input via the operation display 6.

Step S11

First, at Step S11, the control unit 5 uses the image forming unit 3 and the paper sheet feeder 4 to print the inspection image X100 on the sheet. Here, the process of Step S11 is executed by the print processing unit 51 in the control unit 5.

Step S12

At Step S12, the control unit 5 uses the second image reading unit 7 to read the image data from the sheet on which the inspection image X100 is printed at Step S11. Here, the process of Step S12 is executed by the reading processing unit 52 in the control unit 5.

Step S13

At Step S13, the control unit 5 detects the streaky image Y from each of the first image X10 and the second image X20 included in the image data read at Step S12. Here, the process of Step S13 is executed by the detection processing unit 53 in the control unit 5.

Step S14

At Step S14, the control unit 5 detects the gradient of the print density transition in the outer circumference of the streaky image Y when this streaky image Y is detected at Step S13. Here, the process of Step S14 is executed by the detection processing unit 53 in the control unit 5.

Step S15

At Step S15, the control unit 5 determines the cause of abnormality in the image forming unit 3 based on the detection result of the streaky image Y at Step S13 and the detection result of the gradient of the print density transition in the outer circumference of the streaky image Y at Step S14. Here, the process of Step S15 is executed by the determination processing unit 54 in the control unit 5.

Step S16

At Step S16, the control unit 5 determines whether the light scanning device 91 is identified as the cause of abnormality at Step S15 or not.

Here, when the control unit 5 determines that the light scanning device 91 is identified as the cause of abnormality at Step S15 (Yes, at Step S16), the control unit 5 advances the process to Step S17. When the light scanning device 91 is not identified as the cause of abnormality at Step S15 (No, at Step S16), the control unit 5 advances the process to Step S18.

Step S17

At Step S17, the control unit 5 cleans the light transmitting portion 92 that transmits the light irradiating the photoreceptor drum 301 of the print color corresponding to the second image X20 where the streaky image Y detected at Step S13 has occurred. Here, the process of Step S17 is executed by the cleaning processing unit 55 in the control unit 5.

Step S18

At Step S18, the control unit 5 notifies the determination result at Step S15. This ensures the user to know the cause of the occurrence of the streaky image Y when the failure of the appearance of the streaky image Y occurs in the image forming apparatus 10. Here, the process of Step S18 is executed by the cleaning processing unit 55 in the control unit 5.

Thus, in the image forming apparatus 10, the inspection image X100 including the first images X10 and the second images X20 corresponding to the respective print colors is printed on the sheet. Based on the image data read from the sheet on which the inspection image X100 is printed, the streaky image Y is detected from the first image X10 and the second image X20. Then, based on the detection result of the streaky image Y, the cause of abnormality in the image forming unit 3 is determined. This ensures reduction of the labor to identify the cause of the occurrence of the streaky image Y.

The image forming unit 3 may be an image forming unit of the electrophotographic method that can print only a monochrome image. In this case, the inspection image X100 may include only the first image X11 and the second image X21.

EXEMPLARY EMBODIMENT OF THE DISCLOSURE

An image processing apparatus according to one aspect of the disclosure includes a detection processing unit and a determination processing unit. The detection processing unit detects a streaky image along a sub-scanning direction from a first image and a second image among images indicated by image data. The first image has a print density equal to or more than a predetermined reference print-density value. The second image has the print density less than the reference print-density value. The determination processing unit determines a cause of abnormality in an image forming unit of an electrophotographic method based on a detection result of the streaky image by the detection processing unit for each of the first image and the second image.

An abnormality determination method according to another aspect of the disclosure includes: detecting a streaky image along a sub-scanning direction from a first image and a second image among images indicated by image data, the first image having a print density equal to or more than a predetermined reference print-density value, and the second image having the print density less than the reference print-density value; and determining a cause of abnormality in an image forming unit of an electrophotographic method based on a detection result of the streaky image for each of the first image and the second image.

EFFECT OF THE DISCLOSURE

The disclosure achieves an image processing apparatus that ensures reduction of a labor to identify a cause of occurrence a streaky image along a sub-scanning direction, and an abnormality determination method.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. An image processing apparatus comprising:

an image forming unit of an electrophotographic method;

a detection processing unit that detects a streaky image along a sub-scanning direction from a first image and a second image among images indicated by image data, the first image having a print density equal to or more than a predetermined reference print-density value, and the second image having a print density less than the reference print-density value; and a determination processing unit that determines a cause of abnormality in the image forming unit based on a detection result of the streaky image by the detection processing unit for each of the first image and the second image.

2. The image processing apparatus according to claim 1, wherein the image forming unit includes a developing unit that develops an electrostatic latent image, and the determination processing unit identifies the developing unit as the cause of abnormality when the streaky image is detected by the detection processing unit in each of the first image and the second image.

3. The image processing apparatus according to claim 1, wherein the detection processing unit is configured to detect a gradient of a print density transition in an outer circumference of the streaky image, and the determination processing unit determines the cause of abnormality based on presence or absence of the streaky image detected in each of the first image and the second image and the gradient of the print density transition in the outer circumference of the streaky image.

4. The image processing apparatus according to claim 3, wherein the image forming unit includes an image carrier on which an electrostatic latent image is formed, and the determination processing unit identifies the image carrier as the cause of abnormality when the detection processing unit detects the streaky image in only the second image and the gradient of the print density transition is equal to or more than a predetermined threshold value.

5. The image processing apparatus according to claim 3, wherein the image forming unit includes a latent image formation unit that forms an electrostatic latent image, and the determination processing unit identifies the latent image formation unit as the cause of abnormality when the detection processing unit detects the streaky image in only the second image and the gradient of the print density transition is less than a predetermined threshold value.

6. The image processing apparatus according to claim 1, further comprising a notification processing unit that notifies a determination result by the determination processing unit.

7. The image processing apparatus according to claim 1, wherein the image forming unit includes a latent image formation unit that forms an electrostatic latent image, and the image processing apparatus further comprises:

a light transmitting portion that transmits a light based on image data included in the latent image formation unit; and a cleaning processing unit that cleans the light transmitting portion when the determination processing unit determines the latent image formation unit as the cause of abnormality.

8. An abnormality determination method comprising:

detecting a streaky image along a sub-scanning direction from a first image and a second image among images indicated by image data, the first image having a print density equal to or more than a predetermined reference print-density value, and the second image having the print density less than the reference print-density value; and determining a cause of abnormality in an image forming unit of an electrophotographic method based on a detection result of the streaky image for each of the first image and the second image.

* * * * *